United States Patent [19]

Bloomer

[11] Patent Number: 4,461,990

[45] Date of Patent: Jul. 24, 1984

[54] PHASE CONTROL CIRCUIT FOR LOW VOLTAGE LOAD

[75] Inventor: Milton D. Bloomer, Scotia, N.Y.

[73] Assignee: General Electric Company, Schenectady, N.Y.

[21] Appl. No.: 432,000

[22] Filed: Oct. 1, 1982

[51] Int. Cl.[3] ..... G05F 1/445

[52] U.S. Cl. ..... 323/235; 323/238; 323/246; 323/285; 323/901

[58] Field of Search ..... 323/235, 237–238, 323/241, 246, 299–300, 319–322, 901, 908

[56] References Cited

U.S. PATENT DOCUMENTS

| | | | |
|---|---|---|---|
| 3,621,373 | 11/1971 | Mitchell et al. | 323/238 |
| 3,633,095 | 1/1972 | Hood | 323/319 |
| 4,317,975 | 3/1982 | Mizukawa et al. | 323/235 X |
| 4,377,739 | 3/1983 | Eckert, Jr. et al. | 323/235 X |

*Primary Examiner*—Peter S. Wong

*Attorney, Agent, or Firm*—Geoffrey H. Krauss; James C. Davis, Jr.; Marvin Snyder

[57] ABSTRACT

A phase control circuit, for energizing lower voltage loads and the like from a higher voltage A.C. source, utilizes power switching means in series with the load across the source. The load voltage and current are sampled and compared to reference values to determine if the load resistance is less than or greater than a desired value and the output voltage of an integrator is adjusted accordingly. The integrator output voltage establishes the time, after each source waveform zero crossing, at which the power switching device enables load current flow. A reset circuit prevents the power switching device from conducting in the event that a line zero crossing is not properly detected, to preclude damage to the switching device and/or load overvoltage. A circuit is also provided for gradually increasing load current at start-up to limit inrush currents to the load.

13 Claims, 5 Drawing Figures

COUNTER
VCO
PLL
D
C
R
Q
+V
$V_r$
$R_S$
$R_L$
$I_L$
$I_S$
S
D
$L_1$
$L_2$
10
12
14
16
18
20
22
24
26
28
30
32
34
35
36
37
38
39
40
41
44
46
48
50
52
54
56
58
59
60
62
64
66
68
70
72
74
76
80
81
82
84
86
88
92
99
101
103
105
107
109
111
113
115
117
119
121
123
125
127
131
133
135

PHASE CONTROL CIRCUIT FOR LOW VOLTAGE LOAD

BACKGROUND OF THE INVENTION

The present application relates to load-current-controlling circuitry and, more particularly, to a novel phase control circuit for operating a lower voltage resistive load from a higher voltage A.C. line.

It is often desirable to operate a lower-voltage load from a higher-voltage source periodic waveform. Typically, such loads are resistive and have a significant resistive temperature coefficient, whereby use of phase control circuitry for controlling the magnitude of load current will place relatively high stress on switching devices in series with the load. Thus, when a load, such as a lamp, resistance heater element and the like, is to be energized from A.C. mains, but requires less than the full mains voltage thereacross for proper operation, a power switching device in series with the load, across the lines, will be frequently subjected to inordinately high stress and may be damaged. Similarly, if the power device is to be rendered conductive only for a portion of the source waveform cycle, the switching device should be turned on at a proper point in the cycle and remain on for a consistent portion of the cycle. Therefore, loss of synchronization with the source waveform may cause the switching device to either turn on at the wrong time or to turn on for an excessively long time. In either case, load resistance, and therefore load power, is not controlled and the load and/or switching device may be damaged. If the required voltage down-conversion is large, on the order of 4:1 or 5:1, the load may not survive a full source waveform half-cycle of conduction, and it is desirable to absolutely preclude such conduction under improper conditions. It is therefore highly desirable to provide a phase control circuit capable of energizing a low voltage load directly from a higher-voltage (A.C. line) source waveform with controllable resistance and with phase control and switching performed in absolute synchronization with the line waveform. It is also desirable to provide instantaneous shut-down of the series current-conductive device if synchronization with the line waveform is lost. It is similarly desirable to provide for a gradual increase in load current at load start-up, to limit inrush current and prevent load damage.

BRIEF SUMMARY OF THE INVENTION

In accordance with the invention, a novel phase control circuit for energizing a lower-voltage load from a higher-voltage line-to-line source waveform, includes a controllable bidirectionally-conductive power switching device in series with the load across the source. The voltage across the load and the current flowing through the load are both sampled and compared with a reference value to determine whether the load resistance is lower than, or higher than, a desired load resistance. The result of the resistance comparison is utilized to adjust the output voltage of an integrator means in a direction to change the delay of the time, after each zero crossing, at which the series switching device is enabled to the current-conductive condition, thereby adjusting the magnitude of the load current in a manner to control the resistance of the non-zero-temperature coefficient resistance load to a predetermined value. A reset means is provided for monitoring the source waveform zero crossings detected by a zero-crossing detector means, and for resetting the adjustable delay means to prevent operation of the power switching means in the event that a zero crossing is mistimed or completely missed, thus preventing overvoltage damage if line synchronization is lost. Advantageously, a soft-start-up means is provided for gradually increasing the load current at circuit start-up, to limit inrush currents and further protect the load.

In a presently preferred embodiment, a pair of switching devices are utilized, with a first one of the devices conducting during a positive-polarity source waveform half-cycle and the other device conducting for the negative-polarity source waveform half-cycle. Drive signals for the pair of switching devices are derived with reference to the line zero crossings and provide a variable time delay after each zero crossing before turning on the associated device to control the lamp RMS voltage and current. The adjustable delay means utilizes a voltage-controlled-oscillator (VCO) means and a counter, which are both reset at each line zero crossing. The input voltage for the VCO means is derived from a resistance comparator circuit to provide closed-loop control.

Accordingly, it is an object of the present invention to provide a novel phase control power switching circuit for energizing a low voltage load directly from a higher voltage A.C. source.

This and other objects of the present invention will become apparent upon consideration of the following detailed description, when read in conjunction with the drawings.

DETAILED DESCRIPTION OF THE INVENTION

Figure 1:
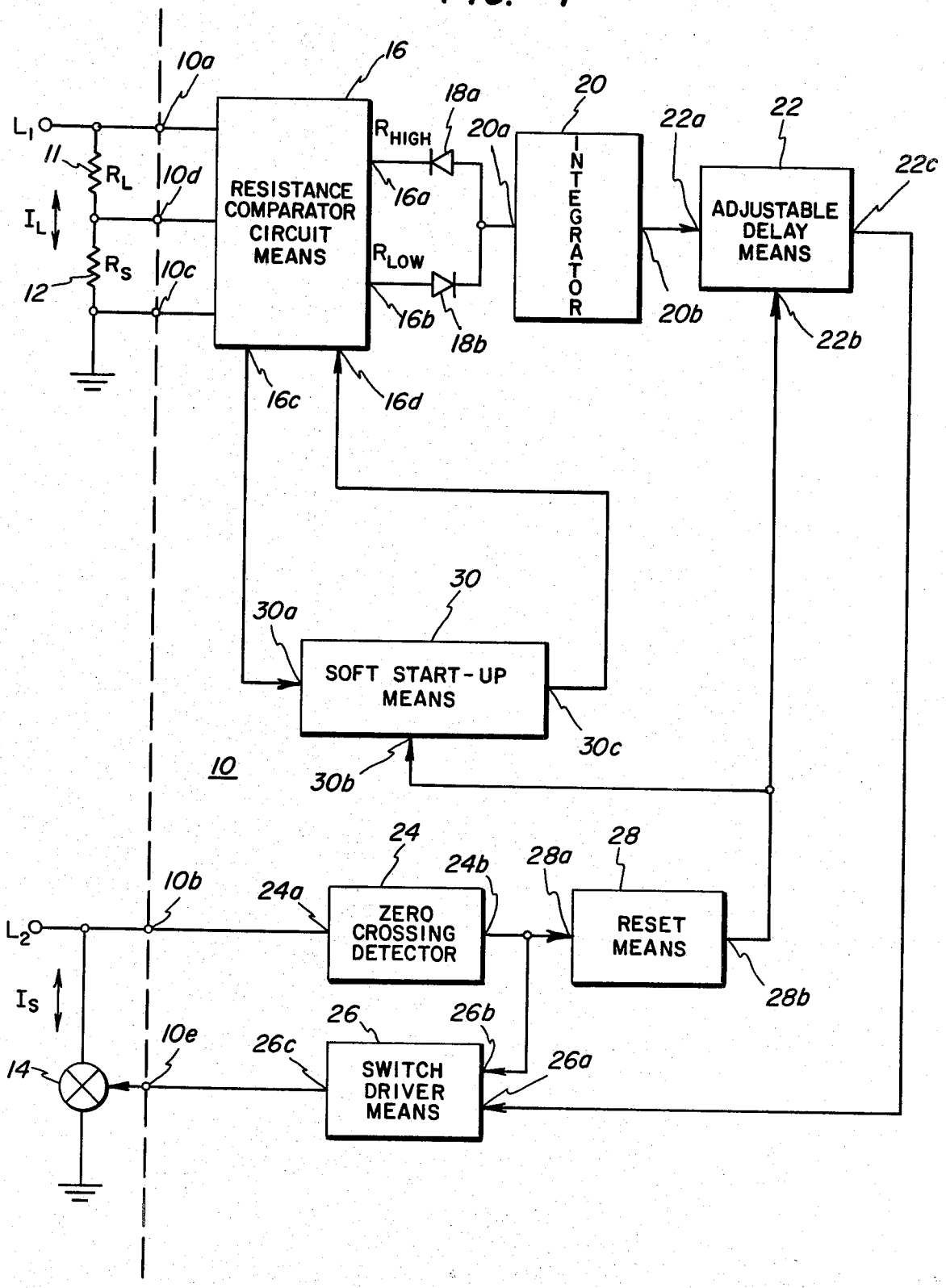
FIG. 1 is a block diagram of a low voltage load phase control circuit used in conjunction with a low voltage load and power switching means.

Referring to the drawings, a phase control circuit 10 is utilized for controlling the flow of load current $I_L$ through a load 11 from a source (not shown) connected thereto by a pair of power lines $L_1$ and $L_2$. The first and second lines are respectively connected to first and second circuit inputs 10*a* and 10*b*, respectively, with a circuit common being connected to input 10*c*. Load current $I_L$ also flows through a sampling resistance 12 of magnitude $R_S$, to provide a voltage at a fourth circuit input 10*d*, with respect to circuit common input 10*c*. Power switching means 14 is effectively in series with load 11 and sensing resistance 12, between lines $L_1$ and $L_2$. A switching means current $I_S$, essentially equal to load current $I_L$, flows responsive to a switching means input signal provided at a control circuit output 10*e*.

Figure 1A:
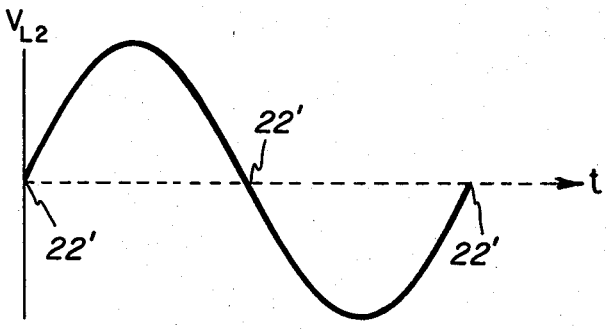
FIGS. 1*a*–1*c* are a set of waveforms useful in understanding operation of the phase control circuit.
Figure 1B:
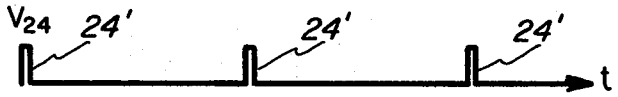

The phase control circuit 10 includes a resistance comparator circuit means 16, illustratively of the type disclosed in the aforementioned co-pending application Ser. No. 382,875, filed May 28, 1982, now U.S. Pat. No. 4,421,993, for a load 11 having a negative temperature coefficient. The resistance comparator circuit means receives the A.C. signals at inputs 10*a* and 10*d*, with respect to common input 10*c*, and provides signals indicating that the load resistance $R_L$ is respectively higher than or lower than a desired resistance, at a respective output 16*a* or 16*b*. These R-HIGH and R-LOW signals are coupled through respective isolation diodes 18*a* and 18*b* to the input 20*a* of an integrator means 20. The signal at integrator means output 20*b* will thus change in a first direction, e.g. decrease, if comparator circuit means output 16*a* is enabled, and will change in the opposite direction, e.g. increase, if the remaining comparator circuit output means 16*b* is enabled. The integrator output signal is applied to a control input 22*a* of an adjustable delay means 22. A reset R input 22*b* of the adjustable delay means receives a signal resetting the delay means output 22*c* at each zero crossing 22' of the line voltage (FIG. 1*a*); output 22*c* is only re-enabled after an adjustable delay time $T_d$ has elapsed after each resetting of means 22. The delay means output 22*c* is connected to one input 26*a* of a switch driver means 26, having a second input 26*b* receiving the zero crossing signal. This zero crossing signal is provided by a zero crossing detector means 24, having an input 24*a* receiving the second line $L_2$ signal at input 10*b*, for providing a pulse 24' at an output 24*b* for each line voltage zero crossing (FIG. 1*b*). The output 26*c* of the switch driver means is coupled to circuit output 10*e* and thence to the switching means 14. The switch driver means output, and therefore switching device 14, is turned off at each line zero crossing 22', responsive to the pulse 24' at input 26*b*, and is turned on, responsive to the signal at input 26*a*, after the time delay $T_d$ interval has elapsed.

Figure 1C:
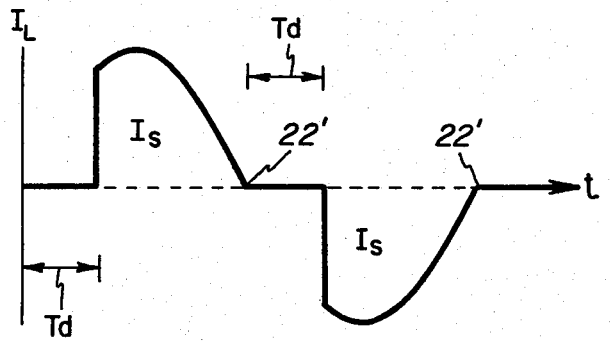

It will be seen that the load current $I_L$ flow (FIG. 1*c*) is thus of an average magnitude controlled by controlling the time delay $T_d$, after each zero crossing 22', of the turn-on of switching device 14 to conduct current $I_S$. The circuit of the present invention, therefore, abruptly turns on an active device during each half cycle of the source waveform and allows the turned-on device to turn off, with a gradual cessation of current flow, at a waveform zero crossing.

Advantageously, circuit 10 also includes a soft start-up means 30 for slowly ramping up the load current $I_L$ at each initial turn on of the load. The soft start-up means has a first input 30*a* receiving a load signal indicative of the load-resistance condition, from an output 16*c* of the resistance comparator circuit means. The soft start-up means also receives the reset means output pulse at another input 30*b*. Start-up means output 30*c* is connected to an input 16*d* of the resistance comparator circuit means for effecting the slow ramping-up of the load curent on initial start-up.

Figure 2:
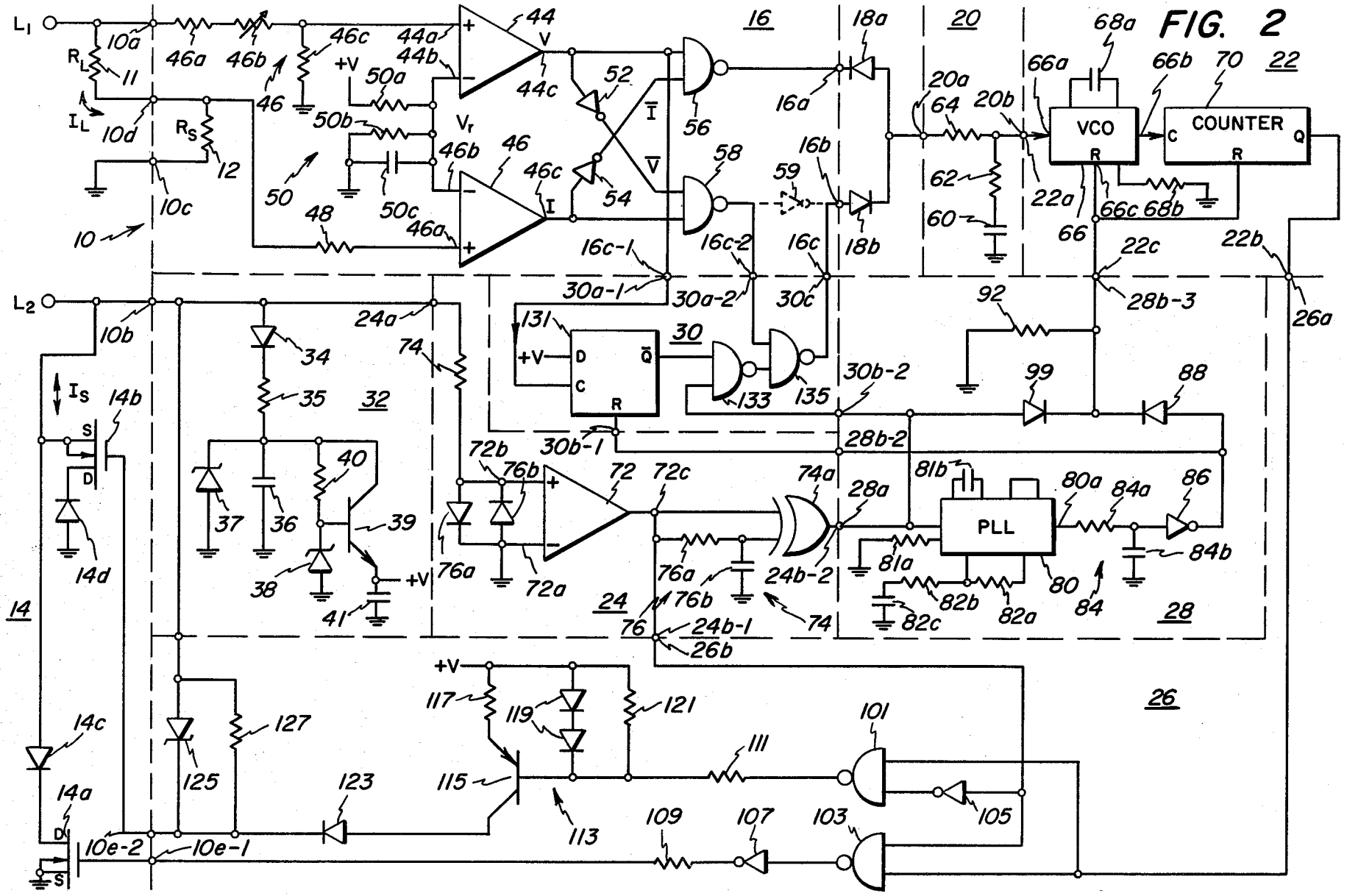
FIG. 2 is a schematic diagram of a presently preferred embodiment of the circuit of FIG. 1.

By way of illustration, the preferred circuit of FIG. 2 utilizes a pair of power metal-oxide-semiconductor field-effect transistors 14*a* and 14*b* in switching means 14, although other switching devices, such as silicon-controlled rectifiers and the like, can be used. Each of devices 14*a* and 14*b* is capable of being turned on during a line waveform half-cycle of a different polarity. First device 14*a* is capable of being placed in a current-conductive condition during the half cycle when line $L_2$ is positive with respect to line $L_1$. Device 14*a* has its source electrode connected to common potential and its drain electrode connected through a unidirectionally-conducting (reverse-current blocking) means, e.g. diode 14*c*, which is positively-poled with respect to line $L_2$. Device 14*b* is capable of being enabled only during the opposite, negative-polarity source waveform half cycle, having the drain electrode thereof connected through a unidirectionally-conducting (reverse-current-blocking) means, e.g. diode 14*d*, which is negatively-poled with respect to line $L_2$. Device 14*b* has its source electrode connected to line $L_2$. The gate electrode of first device 14*a* is connected to a first circuit output 10*e*-1, while the gate of device 14*b* is connected to another circuit output 10*e*-2. The need for separate circuit outputs for driving the switching devices is due to the necessity for shifting the gate drive voltage level with respect to circuit common for second device 14*b*. That is, device 14*b* requires, in this embodiment, a gate drive signal referenced to its source electrode and, therefore, to the line $L_2$ voltage. The required level-shifting circuitry is provided in switch driver means 26, as will be hereinbelow described.

Circuit 10 also includes a power supply means 32 for supplying operating potential +V to the various active portions of circuit 10. Power supply means 32 includes a rectifier diode 34 in series with a current-limiting resistor 35 and filter capacitance 36, having one terminal thereof connected to ground potential. A zener diode 37 is connected across filter capacitor 36, to limit the maximum voltage thereacross. A reference voltage source, e.g. a zener diode 38, is connected to the base electrode of a series-regulating transistor 39. Diode 38 receives operating potential through a series resistance 40, from the voltage across capacitance 36. The collector electrode of pass transistor 39 is connected to capacitor 36, while the emitter electrode of the transistor is connected to a transient-filtering capacitance 41. It will be seen that, as long as the value of zener diode 38 is less than that of zener diode 37, that the values of both zener diodes 37 and 38 are substantially less than the line-common peak voltage, and capacitance 36 stores sufficient charge, then an essentially D.C. voltage is provided at the emitter electrode of transistor 39, for operation of active portions of circuit 10.

The resistance comparator circuit means 16 has been previously described and claimed in my co-pending application Ser. No. 382,875, filed May 28, 1982, assigned to the assignee of the present application and incorporated herein by reference in its entirety. First and second comparators 44 and 46 are used for comparing the actual load voltage and current, respectively, to a reference voltage defining a desired load voltage and current and, therefore, defining a desired load resistance. A non-inverting input 44*a* of the voltage comparator 44 receives a sample of the load voltage, by means of voltage attenuator 46, connected between line $L_1$ input 10*a* and common potential. Illustratively, attenuator means 46 includes a fixed series resistance 46*a* and variable series resistance 46*b*, as well as a shunt resistance 46*c*. By adjustment of variable resistance 46*b*, the time at which the A.C. load voltage exceeds the fixed reference voltage, at the comparator inverting input 46*b*, can be adjusted and will set the time at which the comparator output 44*c* changes state. The current comparator 46 has a non-inverting input 46*a* receiving the A.C. voltage across current sampling resistance 12, via an input resistance 48. The time at which the output 46*c* of the current comparator changes state is determined by the voltage at input 46*a*, with respect to the reference voltage at comparator inverting input 46*b*. The reference voltage $V_r$ is provided by a reference voltage divider network 50 having a first resistance 50*a* connected between operating potential +V and the inverting inputs 44*b* and 46*b*, and a second resistance 50*b* connected from the inverting inputs to common potential. A filtering capacitance 50*c* is connected across resistance 50*b*, to prevent sudden disturbances of the reference potential $V_r$ magnitude. The voltage comparator output 44c signal V will rise to a high (logic 1) level before the current comparator output 46c rises to a high (logic 1) level, and will fall to a low (logic 0) level after the current comparator output 46c falls to a low (logic 0) level, if the load resistance magnitude $R_L$ is higher than desired. The voltage comparator output 44c will rise after and fall before the respective rise and fall of the current comparator output 46c if the load resistance magnitude is lower than desired.

The input of first and second inverters 52 and 54 are respectively connected to the associated one of comparator outputs 44c and 46c and thence to an associated input of a respective one of a pair of two-input NAND gates 56 and 58. The remaining input of each of gates 56 and 58 is connected to the output of the opposite comparator. The output of gate 56 is connected to comparator means R-HIGH output 16a, while the output of gate 58 may be connected, through an inverter 59 (shown by broken line), to comparator means R-LOW output 16b. The voltage at the output of gate 56 will be a low (logic 0) level only if the actual resistance of load 11 is greater than the desired level (set by the reference voltage $V_r$ magnitude) while the output of gate 58 will be at a high (logic 1) level only if the load resi,tance magnitude is less than the desired resistance magnitude.

Integrator means 20 utilizes an integration capacitance 60 connected in series with a resistance 62, between common potential and integrator output 20b. A series integration resistance 64 is connected between integrator input 20a and output 20b. Thus, for a high-load-resistance condition, output 16a falls to a low logic level, discharging integrator capacitor 60, through resistors 62 and 64 and the forward-biased isolation diode 18a. For a low-load-resistance condition, the logic 1 level at output 16b forward biases isolation diode 18b and charges integration capacitance 60 through resistors 62 and 64. The integrator output 20b voltage thus increases for lower-than-desired load resistance and decreases for higher-than-desired load resistance.

The integrator output voltage is applied to adjustable delay means input 22a and thence to the frequency-control voltage input 66a of a voltage-controlled-oscillator VCO means 66. The nominal oscillating frequency of VCO means 66, which may be part of a standard CMOS 4046 integrated circuit and the like, is controlled by an associated capacitor 68a and associated resistor 68b. The controlled-frequency waveform appears at VCO output 66b, except when the output is disabled by a reset signal at a reset R input 66c. The VCO output waveform is applied to the clock C input of a counter means 70. Counter means 70 also has a reset R input connected in parallel with the VCO means reset input 66c to the adjustable delay means resetting input 22c. The counter Q output, establishing the time delay $T_d$ (after a zero-crossing-reset) at which the load current is turned on, is enabled only when a sufficient number of signals have appeared at the clock C input, after the presence of a resetting signal at the reset R input, to cause counter means 70 to count to the desired count. The VCO means frequency decreases for a decreased integrator output voltage, increasing the delay time needed before the Q output of counter 70 is enabled, in the R-HIGH case; conversely, in the R-LOW case, the increased integrator output voltage raises the VCO means frequency and reduces the delay time needed before counter 70 counts the fixed number of VCO output pluses and enables the counter Q output. Advantageously, the counter length and the VCO means minimum frequency, with the voltage at input 66b essentially equal to common potential, are set such that the counter Q output is not enabled in less than the time duration of a source waveform half-cycle after a zero-crossing reset, to keep the switching means 14 completely turned off if a very high load resistance is encountered. Similarly, it is desirable to have the VCO means maximum frequency, set when the input 66a voltage is substantially equal to the supply potential, provide a minimun delay time, between zero-crossing reset and counter Q output enablement, consistent with the maximum RMS voltage to be applied to the load in a minimum-line-voltage condition.

The zero crossing detector 24 utilizes a third comparator 72 having an inverting input 72a connected to common potential and having a non-inverting input 70 to be connected through a series resistance 74 to second line $L_2$. A pair of back-to-back protection diodes 76a and 76b are connected across the comparator inputs. The comparator output 72c changes state at every zero crossing of the line waveform. This line-polarity information is provided at first zero crossing detector output 24b-1 to the switch driver second input 26b. A pulse generator 74 is utilized to provide a short-duration pulse 24' at remaining zero crossing detector output 24b-2. Pulse generator 74 utilizes an exclusive-OR gate 74a having a first input thereof connected to comparator output 72 and a remaining input connected to the comparator output thrugh an edge-delay network 76 comprised of series resistance 76a and shunt capacitance 76b. The output of gate 74a, at output 24b-2, is a pulse of width established by the delay network 76; the pulse appears at each edge of the comparator 72 output square wave, and therefore, at each zero crossing of the line L waveform.

Resetting means 28 utilizes a phase-locked loop (PLL) means 80, which may also be formed from a standard CMOS 4046 integrated circuit and the like. The nominal frequency of the PLL means is set by the values of an associated resistor 81a and an associated capacitor 81b. The response of the loop is partially determined by associated resistors 82a and 82b and capacitance 82c. The lock-detect voltage at a PLL output 80a is of magnitude determined by the locking of the loop to the pulses at input 28a (at twice the line waveform frequency). If the loop frequency is locked to the twice-line-frequency pulse train at input 28a, then output 80a is at a high logic level (a logic 1) whereas output 80a is at a low logic (logic 0) level until the loop attains lock (at circuit start-up) or if the loop falls out of lock because a line zero crossing is missing or occurs at the improper time. It is important to know if a zero crossing is mistimed or completely missing, since zero crossing information absolutely must be known for proper turn-on timing of the non-self-commutating power switching devices 14a and 14b. The PLL means output 80a is low-pass-filtered by a filter 84, comprised of series resistance 84a and shunt filtering capacitance 84b, and is then buffered by an inverter 86. The buffered output is applied to the reset input 30b-1 of the soft-start-up means 30 and is also applied to the anode of a first diode 88. The cathode of diode 88 is connected to the cathode of another diode 90, having the anode thereof connected to the zero-crossing-detector pulse generator output 24b-2. The junction between the anodes and diodes 88 and 90 is connected through a series resistance 92 to common potential to logically OR the signal at input 28*a* and the signal at the output of inverter 86 (which signal is the inverse of the signal at PLL means output 80*a*). The resetting signal at the common-cathode junction is applied to the resetting means output 28*b*-3 for coupling to adjustable delay means resetting input 22*c*. This resetting signal is present, briefly, at each line-zero-crossing (as determined by pulse gate 74*a*) or if lock output 80*a* is low, indicating improper zero-crossing timing.

Switch driver means 26 includes a pair of two-input NAND gates 101 and 103, each having one input connected to driver input 26*a* to receive the delay means enable level. The remaining input of gate 103 is connected to input 26*b* to receive the zero-crossing-detector line-polarity square waveform, while the remaining input of gate 101 is connected through an inverter 105 to receive an inverted-polarity version of the input 26*b* waveform. The output of gate 103 is inverted, by inverter 107, and coupled to driver first output 10*e*-1 through a limiting resistance 109. The output of gate 101 is coupled through a limiting resistance 111 to the input of a level-shifting circuit 113. Circuit 113 comprises a current source, and includes a PNP transistor 115 having its emitter electrode coupled to positive operating potential +V through a resistor 117. A pair of diodes 119 and a shunt resistor 121 are connected from potential +V to the base electrode of device 115. The device collector electrode is connected through a protection diode 123 to driver second output 10*e*-2. A zener diode 125 is used, in parallel with a discharge resistance 127, to limit the maximum source-gate voltage applied to switching device 14*b*.

In basic operation, immediately after a zero crossing, counter 70 has been reset and the Q output thereof is at a logic 0 level. Responsive to this logic 0 level, the output of each of gates 101 and 103 is at a logic 1 level, respectively turning off level-shifting circuit 113 and therefore associated device 14*b*, and placing a logic 0 level at the output of inverter 107 and therefore turning off device 14*a*. In normal operation, after a time delay $T_d$, responsive to the magnitude of the integrator output voltage, the Q output of counter 70 is enabled to a logic 1 level. If the second line L2 voltage is positive with respect to common potential, then a logic 1 level is provided by comparator 72 to the remaining input of gate 103. Therefore, the output of gate 103 falls to a logic 0 level and the output of inverter 107 rises to a logic 1 level, turning on device 14*a* and allowing current to flow through device 14*a* and load 11. During the line $L_2$ positive-polarity source half-cycle, the inverter 105 applies a logic 0 level to the remaining input of gate 101, so that circuit 113 and device 14*b* remain in the turned-off condition even if the Q output of counter 70 is enabled. At the end of the line $L_2$ positive-polarity half-cycle, a zero-crossing pulse appears at zero-crossing detector output 24*b*-2 and thence through diode 90 to input 22*c* of the adjustable delay means. Counter 70 is reset. The resulting logic 0 level at the counter output places both switching devices 14*a* and 14*b* in the non-conductive condition. After another time delay $T_d$ interval, the Q output of counter 70 is again enabled and places a logic 1 level at one input of each of gates 101 and 103. The polarity-detector comparator 72 output waveform is now at a logic 0 level, during the line $L_2$ negative-polarity half-cycle of the source waveform. This logic 0 level is directly applied to gate 103 and provides a logic 0 level at the output of inverter 107, preventing turn-on of switching device 14*a*. The logic 0 level is inverted by inverter 105 and appears as a logic 1 level at the remaining input of gate 101. As both inputs of gate 101 are now at the logic 1 level, a logic 0 level appears at the gate 101 output, turning on device 115 of level-shifting circuit 113. Output terminal 10*e*-2 is brought to a voltage which is of positive-polarity with respect to line terminal 10*b*, and of magnitude determined by zener diode 125, to turn on switching device 14*b* and allow current to flow through that switching device and load 11. At the end of the line $L_2$ negative-polarity source waveform half-cycle, the zero-crossing pulse from gate 74*a* is conducted through diode 90 and resets the output of counter 70, returning switching device 14*b* to the non-conductive condition.

If the load resistance increases, the voltage at the VCO means input 66 decreases, increasing the time delay and causes each of the switching devices 14*a* and 14*b* to conduct for a decreased portion of the associated source waveform half-cycle. If the load resistance decreases, the voltage at the VCO means input 66*a* increases, decreasing the time delay and causing each of switching devices 14*a* and 14*b* to conduct for an increased portion of the associated source waveform half-cycle. By thus controlling the average load current, the voltage drop across the load at a fixed current established by the reference voltage $V_r$, and hence the load resistance, is controlled to a desired value.

If, during normal operation as hereinabove explained, a zero-crossing pulse is missed or occurs at the wrong time, the lock detection output 80*a* of PLL means 80 falls to a logic 0 condition, raising the output of inverter 86 to a logic 1 condition and causing diode 88 to conduct. The Q output of counter 70 is immediately disabled and both switching devices 14*a* and 14*b* are placed in the non-conductive condition, to prevent damage to the switching devices and/or the load. Thus, the phase control circuit either will switch with absolute synchronization with the line, or will instantaneously shut down will synchronization is regained following a synchronization loss. During start-up, integrating capacitor 60 is initially discharged and the voltage thereacross is low, providing a maximum time delay and minimum load current and power.

Soft start-up means 30, utilized to limit inrush current, includes a D-type flip-flop logic element 131, having the data D input thereof connected to the positive operating potential +V and a reset R input connected through input 30*b*-1 to output 28*b*-1 at the output of inverter 86 of the reset means. The clock C input of flip-flop 131 is connected to the output 44*c* of the voltage comparator. The $\overline{Q}$ output of the flip-flop is connected to one input of a first two-input NAND gate 133, having the remaining input thereof connected to the zero-crossing pulse output 24*b*-2 of the zero-crossing detector means. The output of gate 133 is connected to one input of a second two-input NAND gate 135, having the remaining input thereof connected to the output of gate 58 in the comparator circuit means. Inverter 59 is not used and the output of gate 135, at the soft-start-up means output 30*c*, is connected to comparator means output 16*b*. The logic 1 reset voltage at the output of inverter 86, present while the PLL means 80 is obtaining a frequency lock at initial turn-on, causes the $\overline{Q}$ output of flip-flop 131 to be placed at a logic 1 level at circuit turn-on. At each source waveform zero crossing, a logic 1 pulse appears at the output of gate 74*a* and at the remaining input of gate 133. Therefore, a logic 0 pulse will appear at one input of gate 135 at each line waveform zero crossing, causing a logic 1 pulse to appear at comparator output 16b for each zero crossing. These logic 1 pulses are applied to the integrating capacitance to "mock" low-resistance pulses from the resistance comparator, which is not yet operating since both load current and voltage are below their respective thresholds. The "mock" pulses slowly charge the integrating capacitance 60 and slowly decrease the time delay $T_d$. As the time delay is slowly decreased, a slow increase in average load current occurs. As the delay time continues to decrease and the load current is ramped upwardly, the current threshold of the comparator circuit is crossed and logic 0 pulses from the output of gate 58 provide additional logic 1 pulses at circuit output 16b, further charging the integrating capacitor and increasing load current. Thereafter, the voltage threshold is crossed for the first time and a logic 1 level is applied to the clock C input of flip-flop 131, setting the $\bar{Q}$ output thereof to the logic 0 level and disabling gate 133. The level at the output of gate 58 is transferred through gate 135 and normal operation commences. Thereafter, control of switching device conduction time remains completely under the control of the resistance comparator means 16, until a zero crossing is missed, due to noise or shut down, whereafter the soft start-up means 30 is again activated to prevent new inrush current from flowing through load 11.

While a presently preferred embodiment of my novel phase control circuit for energizing a low voltage load has been described in detail herein, many variations and modifications will become apparent to those skilled in the art. It is my intent, therefore, to be limited only by the scope of the appending claims, and not by the specific details or instrumentalities presented by way of explanation herein.

What is claimed is:

1. A circuit for energizing a lower-voltage load from a higher-voltage A.C. source, comprising:

switching means, in series connection with said load across said source, for conducting a flow of current through said load;

means for monitoring the actual magnitude of the resistance of said load and for providing a signal having a characteristic varying responsive to the difference between said actual load resistance magnitude and a desired load resistance magnitude;

reset means for causing said switching means to cease load current conduction at each of a plurality of periodic zero crossings of the waveform of said source; and delay means for causing said switching means to commence load current conduction at a time, after each source waveform zero crossing, adjustably responsive to said varying signal characteristic and serving to maintain said load resistance at said desired magnitude.

2. The circuit of claim 1, wherein said switching means includes first and second switching devices, each adapted for conduction of current therethrough during a different one of first and second polarity portions of said source waveform.

3. The circuit of claim 2, wherein each of said switching devices is a field-effect transistor.

4. The circuit of claim 2, further comprising unidirectionally-conducting means in series with each of said switching devices for preventing current flow through the associated switching device during the opposite-polarity portion of the source waveform.

5. The circuit of claim 2, wherein said switching means further comprises gating means responsive to said reset means and said delay means for turning each of said switching devices on and off.

6. The circuit of claim 5, further comprising means for shifting an output level from at least one of said gating means for application to an associated one of said switching devices.

7. The circuit of claim 1, further comprising means for detecting at least one of the absence and mistiming of the periodic source waveform zero crossings to provide another signal; said reset means being immediately operated and said delay means being inhibited both responsive to said another signal.

8. The circuit of claim 7, further including start-up means for gradually increasing said load current magnitude toward a normal value thereof, responsive to each energization of said circuit.

9. The circuit of claim 8, wherein said start-up means also operates responsive to each occurrence of said another signal.

10. The circuit of claim 7, wherein said detecting means includes phase-locked loop means, receiving the periodic zero crossings as a reference frequency, for providing said another signal whenever a line waveform zero crossing fails to occur with a predetermined relationship to one of the periodic zero crossings.

11. The circuit of claim 1, further including start-up means for gradually increasing said load current magnitude toward a normal value thereof, responsive to each energization of said circuit.

12. The circuit of claim 1, wherein said resistance monitoring means includes means for providing first and second signals respectively responsive to the actual load resistance magnitude being respectively less than and greater than the desired load resistance magnitude; and means for integrating the first and second signals to provide said signal with a varying magnitude characteristic.

13. The circuit of claim 12, wherein said delay means comprises oscillator means having an output waveform of frequency responsive to the magnitude of said signal; and counter means for providing a turn-on signal to said switching means after a time delay interval established responsive to counting a predetermined number of oscillator means waveform cycles.

* * * * *